US006568573B2

(12) United States Patent
Manigley et al.

(10) Patent No.: US 6,568,573 B2
(45) Date of Patent: May 27, 2003

(54) WRISTWATCH CASE WITH INTERCHANGEABLE BRACELET

(76) Inventors: Louis Dominique Manigley, 10, rue de Saint-Pierre, Fribourg (CH), 1700; Marco Scarinzi, Rue de l'Eau 42, Bienne (CH), 2502; Renato Scarinzi, Rue de l'Eau 42, Bienne (CH), 2502

( * ) Notice: Subject to any disclaimer, the term of this patent is extended or adjusted under 35 U.S.C. 154(b) by 0 days.

(21) Appl. No.: 09/813,647

(22) Filed: Mar. 21, 2001

(65) Prior Publication Data

US 2002/0096544 A1 Jul. 25, 2002

(30) Foreign Application Priority Data

Jan. 23, 2001 (CH) ..... 0108/01

(51) Int. Cl.[7] ..... A44C 5/00

(52) U.S. Cl. ..... 224/164; 24/265; 224/167; 224/179

(58) Field of Search ..... 224/164, 167, 224/170, 178, 179; 368/282, 287, 88, 264; 24/265 WS, 717

(56) References Cited

U.S. PATENT DOCUMENTS

| | | | | | |
|---|---|---|---|---|---|
| 2,163,220 | A | * | 6/1939 | Schmitz | 224/172 |
| 3,492,809 | A | * | 2/1970 | Gisiger-Lusa | 368/282 |
| 3,735,584 | A | * | 5/1973 | Tokunaga | 368/287 |
| 4,742,503 | A | * | 5/1988 | Braun et al. | 368/282 |
| 4,817,064 | A | * | 3/1989 | Milles | 224/164 |
| 4,958,279 | A | * | 9/1990 | Proellochs | 224/179 |
| 5,639,000 | A | * | 6/1997 | McDaniel et al. | 224/164 |
| 5,899,370 | A | * | 5/1999 | Bould | 224/164 |
| 5,914,913 | A | * | 6/1999 | Shriqui | 224/164 |

FOREIGN PATENT DOCUMENTS

| | | |
|---|---|---|
| EP | 0797132 | 9/1997 |
| FR | 1598983 | 8/1970 |

* cited by examiner

*Primary Examiner*—Stephen K. Cronin
*Assistant Examiner*—Maerena W. Brevard
(74) *Attorney, Agent, or Firm*—Pennie & Edmonds LLP

(57) ABSTRACT

A watch case with an interchangeable bracelet system includes a back with a neck to which a portion of a bracelet is removably coupled. A closure element closes the neck and pinches the bracelet against the back of the case. Preferably, the closure element is a ring that is attached to the back of the case by means of a bayonet device consisting of a lug that is inserted in a mating hollow. To prevent accidental separation of the closure element from the case, a compression joint may be placed in a seat provided in either the back of the case or in the closure element. The closure element compresses the joint and frictionally prevents accidental opening. The device enables the bracelet to be changed easily without tools.

20 Claims, 3 Drawing Sheets

WRISTWATCH CASE WITH INTERCHANGEABLE BRACELET

FIELD OF THE INVENTION

The present invention relates to an interchangeable bracelet or strap system for a wristwatch.

BACKGROUND OF THE INVENTION

There are several known examples of wristwatches in which the bracelet or strap thereof is secured by being pinched between two parts of the case. The bracelet may be composed of two separate parts or of two parts connected to each other by a median portion comprising an opening corresponding to the shape of the case or the shape of a portion of the case.

For example, French Patent No. 504,267 (Rubattel et Weyermann SA) describes a watch whose bracelet, consisting of a one-piece, rectangular gold band, comprises a round opening that exposes the dial, the inner edge of the opening in the bracelet being gripped between the middle of the case and an apposed bezel. Thus, the bracelet covers the entire case except for the glass and the dial. Another device of the same kind is presented in French Patent No. 1,598,983 (Ervin Piquerez). Here the bracelet does not cover the case. The edge of the central opening of the bracelet conforms to the outer shape of the case and is pinched between the middle of the case and a ring that is screwed either onto the upper portion of the middle or onto the back of the case.

Other examples, such as Swiss Patent No. 340786 (Vallon) or No. 355095 (Sorna Watch Co.), disclose bracelets formed of two separate parts with dovetail-shaped ends inserted into slots of corresponding shape provided in the middle of the case to attach the bracelet to the case. The ends of the bracelet parts are held in the slots by the case back, which is screwed on or fastened by means of detents.

The essential purpose of the above-described devices is, chiefly for esthetic reasons, to eliminate the need for prongs to fasten the bracelet.

The mounting and removal of the bracelet on or from the case—whether by screwing action or even by means of detents—requires a key or tool and virtually must, in practice, be performed by a professional. This is all the more true since, in most of the examples cited above, removal exposes the inner workings of the watch. The known devices therefore cannot be applied to watches sold with a plurality of interchangeable bracelets, which allow the consumer to change the bracelet by himself.

There are, of course, various systems quite different from the foregoing examples that enable the user to change the bracelet easily. These include, for example, Swiss Patent No. 685464 (Le Marquand) and European Patent No. 0797132 (Bourquin and Wiser). Although these devices function satisfactorily, they nevertheless require the presence of prongs or excrescences of the same type.

SUMMARY OF THE INVENTION

The present invention provides a watch case with an interchangeable bracelet that enables the user to change the bracelet easily, without any special tools, and without it being necessary to provide the case with prongs.

BRIEF DESCRIPTION OF THE DRAWING

The detailed description will be better understood in conjunction with the accompanying drawings, showing an embodiment of the invention as an example and wherein like reference characters represent like elements, as follows.

DETAILED DESCRIPTION OF THE INVENTION

Figure 1:
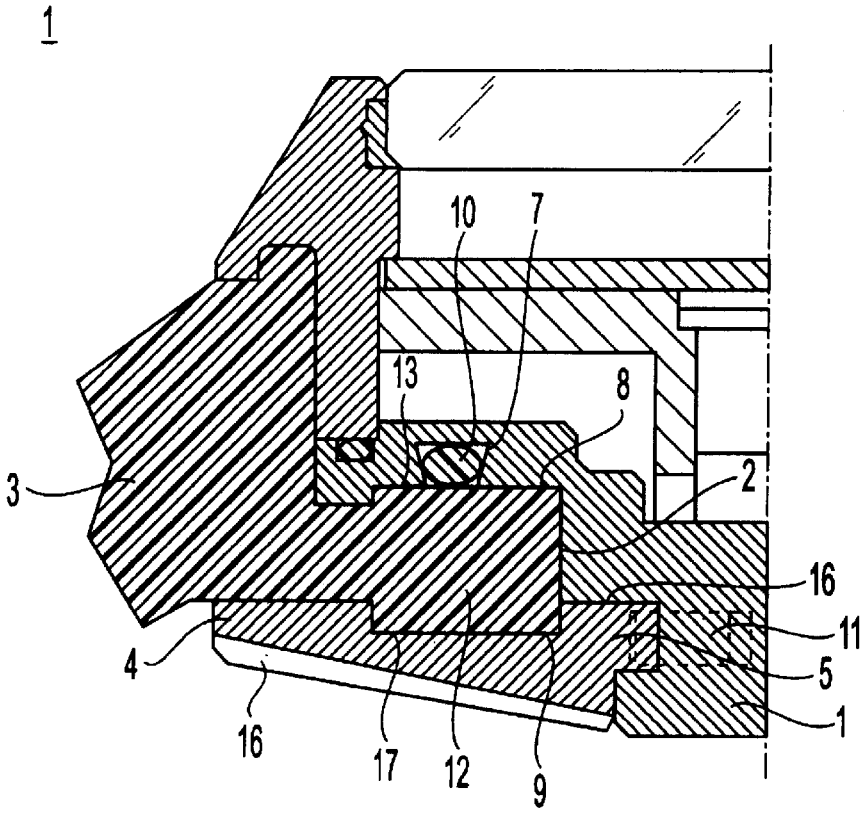
FIG. 1 is a partial vertical cross-sectional view of a case with bracelet in accordance with the principles of the present invention.

In accordance with the principles of the present invention, a watch case has a back 1 which is readily coupled to and decoupled from a bracelet 3 without the need for special tools. In the embodiment shown in the drawings, bracelet 3 is composed of one piece, the two wrist-engaging parts being connected to each other by an annular portion 12. Annular portion 12 has an opening able to receive a portion of back 1 of the watch case bound laterally by an annular neck 2. Neck 2 may extend completely around back 1 or only around a portion thereof. It will be appreciated that bracelet 3 may be formed as two separate parts instead, if desired. In such embodiment an attachment end is provided on each part of the bracelet configured to facilitate attachment to back 1, such as in neck 2.

Figure 3:
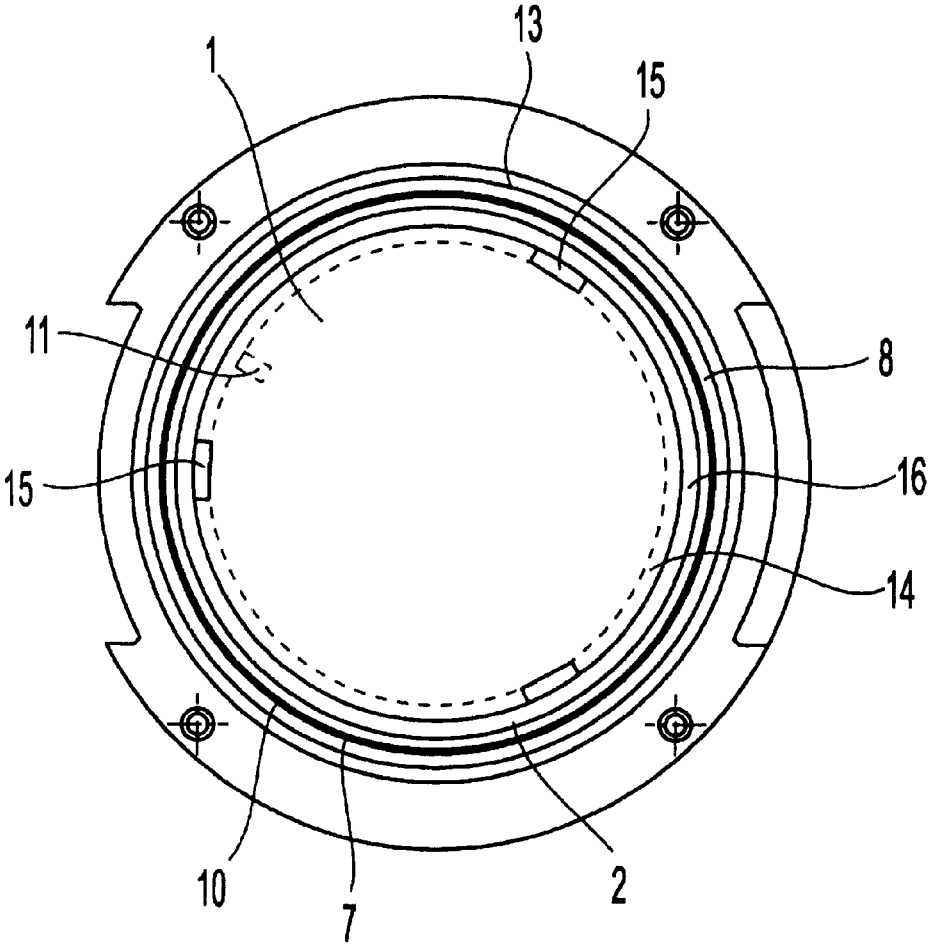
FIG. 3 is a bottom view of the back of the case of FIG. 1.

Provided below annular neck 2 is a hollow 6 configured for engagement with bracelet 3. In the embodiment shown in the figures, hollow 6 passes all the way around the portion of back 1 bound by neck 2. However, a shorter circumferential extent of hollow 6 is within the scope of the present invention as well, as will be appreciated. A flange 14 is formed below hollow 6 with at least one cutout 15 therein to permit access to hollow 6. In the embodiment of FIG. 3, three cutouts 15 are provided substantially equidistant from one another. However, other configurations are within the scope of the present invention.

Figure 2:
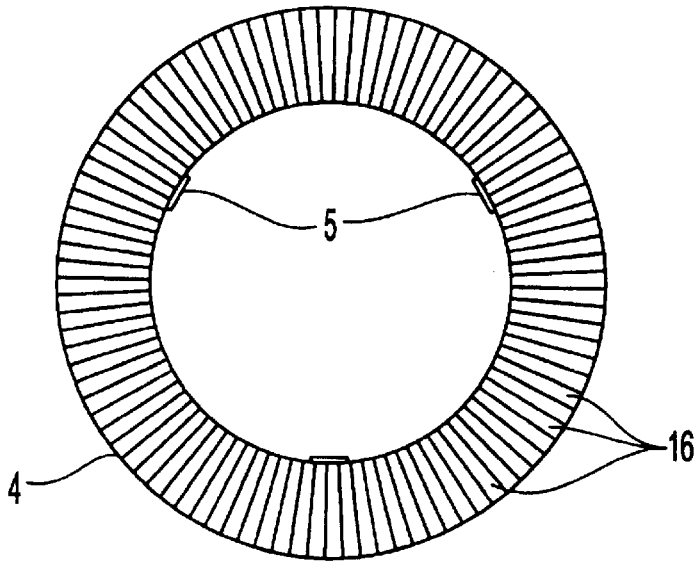
FIG. 2 is a bottom view of a closure element in accordance with the principles of the present invention.

In order to couple bracelet 3 to the watch case of the embodiment shown in the figures, annular portion 12 of bracelet 3 is placed in annular neck 2 of back 1. An annularly shaped closure element 4 closes annular neck 2 such as by insertion of at least one lug 5 on closure element 4 through a cutout 15 and into a retaining portion in hollow 6. In the embodiment of FIG. 2, closure element 4 is provided radially with three inwardly oriented lugs 5 corresponding to the three cutouts 15 in flange 14 of FIG. 3. However, other configurations are within the scope of the present invention. Annular portion 12 of bracelet 3 is thereby trapped between upper face 9 of closure element 4 and edge 8 of neck 2. To hold lugs 5 in hollow 6, closure element 4 is rotated so that lugs 5 move laterally and are completely gripped between flange 14 and the other wall 16 of hollow 6.

Such connection of closure element 4 into hollow 6 by means of lugs and cutouts may be described as a bayonet connection and provides a simple manner of coupling and decoupling closure element 4 to the watch case to secure and to release, respectively, bracelet 3. It will be appreciated that such connection is simple to achieve as well as to release, and thus permits a user to secure and to release a bracelet 3 to the watch case as desired without the need for any tools. Because lugs 5 are held in a retaining portion formed in hollow 6 away from cutouts 15, once lugs 5 are inserted in hollow 6 no further tightening is required, as would be the case with a screw-on closure element as in the prior art. Thus, tools are also obviated because of the lack of a need to tighten closure element 4 onto the watch case in the closed position.

In order to facilitate manual manipulation of closure element 4 without a special tool, a grasping surface preferably is formed on the lower face of closure element 4. For example, radial grooves 16 may be made in the lower face of closure element 4 to provide an adequate grip for the fingers of the user wishing to change bracelet 3 as shown in FIG. 2. It will be appreciated that other configurations facilitating manual manipulation of closure element 4 are within the scope of the present invention.

Figure 4:
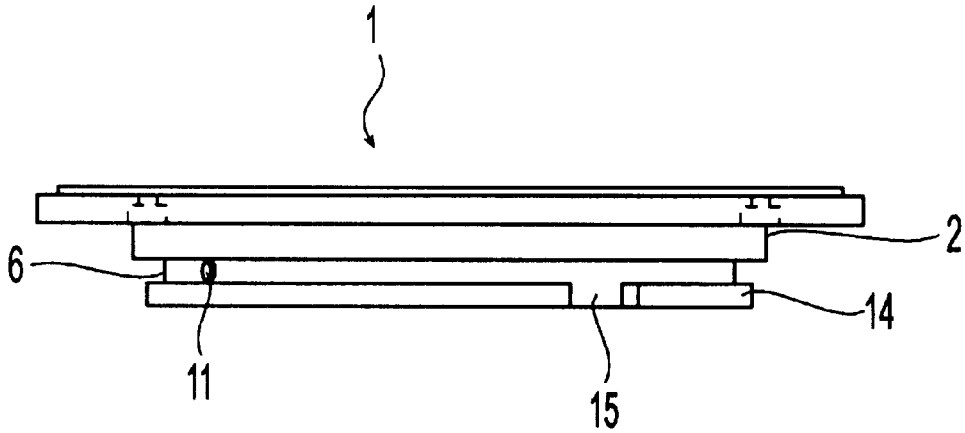
FIG. 4 is a side view of the back of the case of FIG. 3.
Figure 5:
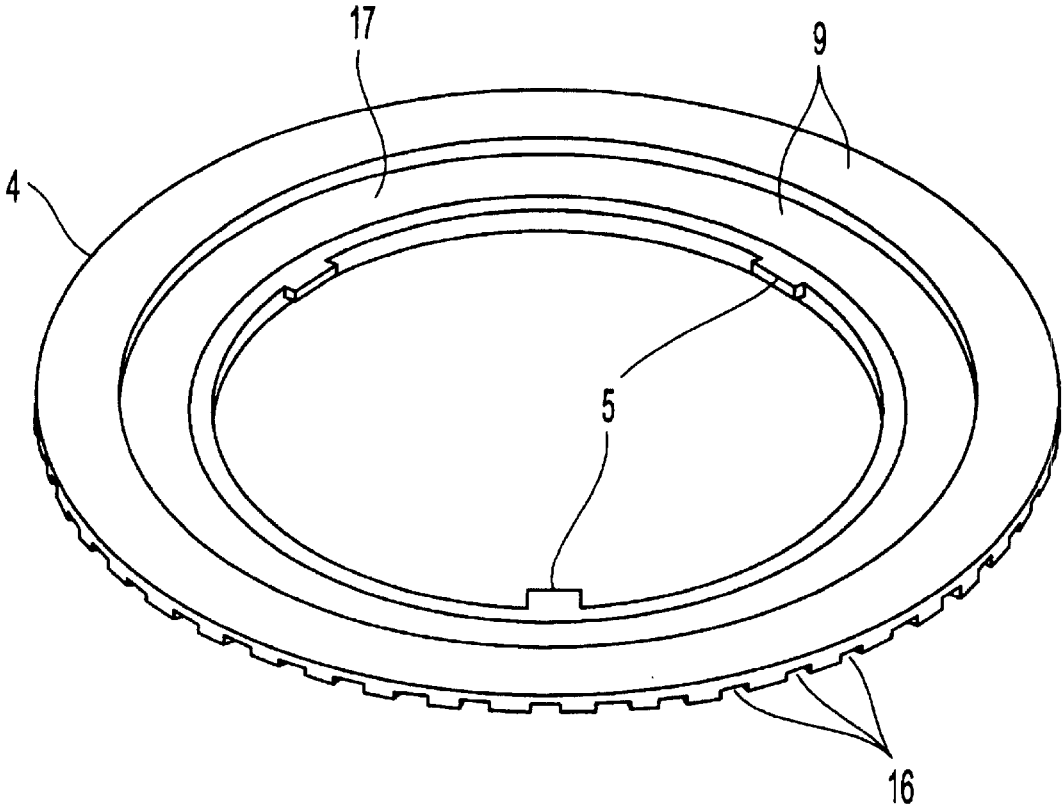
FIG. 5 is an isometric view of the closure element of FIG. 2.
Figure 6:
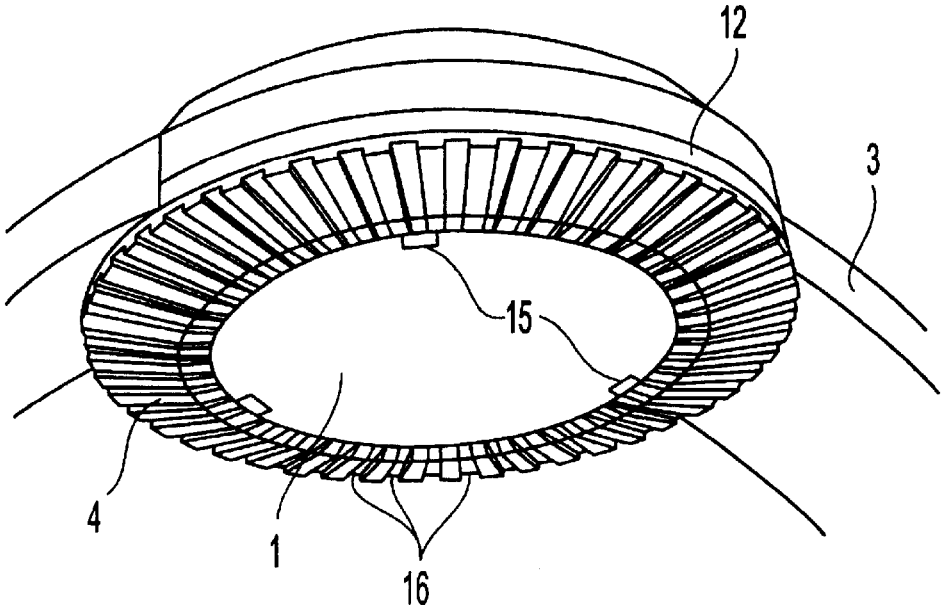
FIG. 6 is an isometric view of the case assembled with the bracelet, the bracelet being only partially mounted thereon.

To halt the rotational travel of closure element 4 so that the at least one lug 5 does not reach and fall out the next cutout 15, a stop 11 is fastened in hollow 6. In the embodiment shown in FIGS. 1, 3, and 4, stop 11 is in the form of a cylindrical key driven into a radial hole made in the back of the hollow 6. Other configurations of stop 11 which block further, unwanted movement of a lug 5 within hollow 6 are within the scope of the present invention.

Although stop 11 does halt the rotation of closure element 4 in the closing direction, it has no effect in the opening direction opposite the closing direction, returning lugs 5 to cutouts 15 through which lugs 5 entered hollow 6. To prevent accidental rotation of closure element 4 in the opening direction causing untimely opening of closure element 4 and release of bracelet 3, it is necessary to inhibit slippage of closure element 4 in the opening direction. To this end, it is possible, for example, to increase the thickness of bracelet 3 slightly so that closure element 4 compresses bracelet 3 when in a closed position. As a result, the pressure so exerted on upper face 9 of closure element 4 frictionally prevents closure element 4 from slipping in reverse and in the opening direction. However, such compression, which must be exactly proportioned, requires, on the one hand, that bracelet 3 be made of a compressible and/or deformable material, and on the other hand, that the thickness of bracelet 3 be very precisely machined. The first requirement is not met in the case of a metal bracelet, and the second is very difficult to achieve in practice.

To obtain the desired effect of pressure and hence friction between closure element 4 and bracelet 3 and/or the watch case to prevent accidental dislodgment of closure element 4 and consequent opening, a rotation-inhibiting element is provided between closure element 4 and the watch case. Such rotation inhibiting-element may inhibit relative rotation in any manner known to one of ordinary skill in the art. For instance, the rotation-inhibiting element may increase friction between closure element 4 and a portion of base 1. Alternatively, or in addition, the rotation-inhibiting element may exert a restraining force against closure element 4 to restrain closure element 4 against further rotation. Such force exerts pressure on upper face 9 of closure element 4 to prevent accidental or undesired slippage of closure element 4 in the opening direction. If desired, the rotation-inhibiting element may be held within a portion of back 1 or closure element 4. In the embodiment of FIG. 1, a seat 7 is provided in edge 8 of neck 2 shaped to hold a rotation-inhibiting element in the form of a compression joint 10, such as an O-ring. Although seat 7 and compression joint 10 are annular in FIG. 1, other configurations are within the scope of the invention. Closure element 4 compresses joint 10 via annular portion 12 of bracelet 3. Annular portion 12 thereby exerts friction on upper face 9 of closure element 4, preventing closure element 4 from rotating in the opening direction. Of course, the dimensions of joint 10 are to be calculated so that the friction allows the user to open closure element 4 without undue effort so that the user may easily exchange bracelets 3 as desired. Thus, the rotation-inhibiting element acts as a braking element which provides just enough resistance to prevent accidental opening of closure element 4 yet not so much as to make intentional opening of closure element 4 unduly difficult. It will be appreciated that the provision of a rotation-inhibiting element is separate and independent from the particular manner of coupling closure element 4 to the watch case to secure bracelet 3 in place with respect to the watch case, such as the bayonet connection described above.

Another feature which may be provided in the watch case and bracelet system of the present invention is a connection between bracelet 3 and the watch case which inhibits accidental separation of bracelet 3 from the watch case. In the embodiment of FIG. 1, circular cut-outs 13 and 17 are provided respectively in back 1 of the watch case and on upper face 9 of closure element 4 and confront each other. Bulges of corresponding shape on bracelet 3, such as at annular portion 12, preferably are inserted into cut-outs 13 and 17 to secure the attachment of bracelet 3 to the watch case. As such, the bulges are locked between closure element 4 and back 1 when closure element 4 is in a closed position.

The embodiment described herein constitutes an illustrative embodiment. Other forms are possible, however. For example, the case can have plural backs, for instance disposed one on top of the other; the attaching device can have plural annular necks; the bracelet can be formed of two separate parts, in which case there can be two necks; the device can comprise plural closure elements, or only one lug instead of three, in which case the lug must have a sufficient angular dimension; finally, the hollow receiving the lugs can be divided into a plurality of segments instead of being continuous, or a plurality of hollows may be provided, such as spaced at different distances from back 1. The compression joint 10 could also be placed in a seat 7 provided in upper face 9 of closure element 4, instead of in edge 8 of neck 2. It is also conceivable for a plurality of stops 11, instead of just one, to be placed in hollow 6.

Thus, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A watch case with an interchangeable bracelet comprising at least one back with at least one neck into which a portion of said bracelet is inserted and at least one closure element that closes said neck and holds said bracelet therein, wherein said closure element is attached to said back by means of a bayonet connection having at least one lug that is inserted into at least one mating hollow and rotated into a gripping position.

2. A watch case with interchangeable bracelet as in claim 1, wherein said neck is annular and extends completely around said back.

3. A watch case with interchangeable bracelet as in claim 1, wherein a rotation-inhibiting element is provided between said bracelet and one of said neck or said closure element.

4. A watch case with interchangeable bracelet as in claim 3, wherein said rotation-inhibiting element is dimensioned so that closing of said closure element compresses said bracelet against said rotation-inhibiting element.

5. A watch case with interchangeable bracelet as in claim 4, wherein:

said neck is provided with an edge;

said bracelet is gripped between said neck edge and said closure element; and said rotation-inhibiting element is provided between said bracelet and one of said neck edge or said closure element.

6. A watch case with interchangeable bracelet as in claim 5, wherein:

at least one seat is provided in one of said neck edge or said closure element; and said rotation-inhibiting element is provided in said seat.

7. A watch case with interchangeable bracelet as in claim 1, wherein said hollow is continuous and at least one stop is disposed in said hollow such that said at least one lug abuts said stop when said closure element is in a closed position.

8. A watch case with interchangeable bracelet as in claim 1, wherein said bracelet is formed of a single piece having first and second wrist strap portions and a centrally positioned portion shaped for insertion at least partially in said neck.

9. A watch case with interchangeable bracelet as in claim 1, wherein said closure element has a lower face with a grasping surface configured to facilitate manual grasping by a user to manipulate said closure element with respect to said watch case.

10. A watch case with interchangeable bracelet as in claim 1, wherein said closure element has an axis of rotation and said bayonet connection is accomplished by inserting said at least one lug into said mating hollow by moving said closure element axially along said axis of rotation and then rotating said closure element about said axis of rotation into a gripping position.

11. A watch case with interchangeable bracelet as in claim 1, further comprising a watch face, wherein said neck extends downwardly from said watch case below and away from said face and has a side, and said closure element extends around said side.

12. A watch case with interchangeable bracelet as in claim 1, wherein said closure element encloses and then is rotated about said neck into said gripping position.

13. A watch case with interchangeable bracelet comprising:

a watch case;

a bracelet removably coupled to said watch case;

a closure element configured to secure said bracelet to said watch case as a result of rotation of said closure element relative to said watch case; and a rotation-inhibiting element between said watch case and said closure element configured to inhibit rotation of said closure element with respect to said watch case;

wherein:

said closure element secures said bracelet to said watch case upon rotation of said closure element in a closing direction with respect to said watch case;

said closure element releases said bracelet from said watch case upon rotation of said closure element in an opening direction with respect to said watch case opposite said closing direction; and said rotation-inhibiting element inhibits rotation of said closure element with respect to said watch case.

14. A watch case with interchangeable bracelet as in claim 13, wherein said rotation-inhibiting element exerts pressure against said closure element to restrain said closure element against movement in said opening direction.

15. A watch case with interchangeable bracelet as in claim 13, wherein said rotation-inhibiting element increases friction between said closure element and said watch case to inhibit rotation of said closure element in said opening direction.

16. A watch case with interchangeable bracelet as in claim 13, wherein said watch case includes at least one back having at least one neck into which a portion of said bracelet is inserted.

17. A watch case with interchangeable bracelet as in claim 16, wherein:

said neck is provided with an edge;

said bracelet is gripped between said neck edge and said closure element; and said rotation-inhibiting element is provided between said bracelet and one of said neck edge or said closure element.

18. A watch case with interchangeable bracelet as in claim 17, wherein:

at least one seat is provided in one of said neck edge or said closure element; and said rotation-inhibiting element is provided in said seat.

19. A watch case with interchangeable bracelet as in claim 13, wherein said rotation-inhibiting element is a compression joint.

20. A watch case with interchangeable bracelet as in claim 13, wherein said rotation-inhibiting element is an o-ring.

* * * * *